US006484632B2

(12) United States Patent
Hoffmann et al.

(10) Patent No.: US 6,484,632 B2
(45) Date of Patent: Nov. 26, 2002

(54) RUBBER CYLINDER SLEEVE, ESPECIALLY FOR WEB-FED ROTARY OFFSET PRINTING MACHINES

(75) Inventors: Eduard Hoffmann, Bobingen (DE); Peter Knauer, Münster/Lech (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/862,725

(22) Filed: May 23, 2001

(65) Prior Publication Data

US 2002/0002921 A1 Jan. 10, 2002

(30) Foreign Application Priority Data

May 23, 2000 (DE) ..... 100 25 374

(51) Int. Cl.[7] ..... B41F 5/00; B41F 7/02; B41F 13/10

(52) U.S. Cl. ..... 101/217; 101/216; 101/375; 101/376

(58) Field of Search ..... 101/217, 375, 101/376, 216, 368, 401.1

(56) References Cited

U.S. PATENT DOCUMENTS

| | | | | |
|---|---|---|---|---|
| 4,125,073 A | | 11/1978 | Bain | 101/216 |
| 5,304,267 A | | 4/1994 | Vrotacoe et al. | 156/86 |
| 5,323,702 A | | 6/1994 | Vrotacoe et al. | 101/217 |
| 5,351,615 A | | 10/1994 | Köbler et al. | 101/217 |
| 5,429,048 A | | 7/1995 | Gaffney et al. | 101/217 |
| 5,440,981 A | | 8/1995 | Vrotacoe et al. | 101/217 |
| 5,768,990 A | * | 6/1998 | Vrotacoe et al. | 101/217 |
| 5,832,824 A | * | 11/1998 | Okubo et al. | 101/217 |
| 6,148,725 A | * | 11/2000 | Knauer et al. | 101/217 |
| 6,289,809 B1 | * | 9/2001 | Sonobe | 101/401.1 |

FOREIGN PATENT DOCUMENTS

| | | |
|---|---|---|
| DE | 35 12 776 | 10/1986 |
| DE | 35 12 776 | 2/1989 |
| DE | 43 07 320 | 7/1994 |
| DE | 43 23 750 | 1/1995 |
| DE | 199 50 643 | 4/2001 |

OTHER PUBLICATIONS

Patent Abstracts of Japan, JP 10058853 A, Mar. 1998.

* cited by examiner

*Primary Examiner*—Andrew H. Hirshfeld
*Assistant Examiner*—Marvin Crenshaw
(74) *Attorney, Agent, or Firm*—Cohen, Pontani, Lieberman & Pavane

(57) ABSTRACT

A rubber cylinder sleeve for web-fed rotary offset printing machines has a covering layer which is a finite layer having a joint location, the joint location being filled with a compressible material.

11 Claims, 3 Drawing Sheets

RUBBER CYLINDER SLEEVE, ESPECIALLY FOR WEB-FED ROTARY OFFSET PRINTING MACHINES

BACKGROUND OF THE INVENTION

1. Field of the Invention

The invention relates to a rubber sleeve having an inner carrier sleeve which can be expanded by means of air, at least one compressible layer arranged over the carrier sleeve, and an outer covering layer. A similar device is disclosed in U.S. Pat. No. 6,148,725.

2. Description of the Related Art

Sleeves of this type are disclosed, for example, by U.S. Pat. Nos. 5,429,048, 5,323,702, 5,440,981 and 5,304,267. One disadvantage of these known rubber cylinder sleeves (transfer cylinder sleeves) is that the middle and lower layers of the same have to be at least partly continuous. This has a particularly detrimental effect on the production costs.

In addition, U.S. Pat. No. 5,351,615 discloses the practice of applying a rubber blanket to a carrier plate, for example by adhesive bonding. After this, this arrangement is shaped into a rubber cylinder sleeve and the mutually facing ends of the carrier plate and those of the rubber blanket or rubber covering are joined to each other, for example by welding or adhesive bonding. Although this arrangement no longer has a gap, a joining seam or a joint location remains on the surface.

In the rubber cylinder sleeve shown in U.S. Pat. No. 5,429,048, its outer layer is continuously sleeve-like and consists of an incompressible material. Apart from the higher production costs already mentioned, a continuous outer layer has the disadvantage that, during rolling contact with a plate cylinder and an impression cylinder, the rubber blanket sleeve is loaded with tangential forces to which further forces are added with each revolution. High loading on the rubber blanket sleeve is established. This loading also has a detrimental effect on the printing quality (for example by a tendency to slippage of the rubber blanket sleeve in relation to the web to be printed. in the press nip, and in the rolling nip with a plate cylinder).

SUMMARY OF THE INVENTION

It is an object of the present invention to produce a genus-forming rubber cylinder sleeve, especially for web-fed rotary offset printing machines, more cheaply as compared with the known sleeves of this type, with approximately the same or improved printing quality and behaviour.

The object is achieved by designing the covering layer as a finite layer having a joint location which is filled with a compressible material. The rubber cylinder sleeve can be produced cost-effectively. In addition, it makes possible good printing quality since the joint location filled with compressible material is permitted to dissipate tangential forces during rolling contact with other printing-unit cylinders.

As is known from the prior art described above, the fundamental construction of such rubber cylinder sleeves substantially comprises an inner, preferably metallic sleeve. However, a glass-fibre reinforced (GRP) sleeve can also be used advantageously instead of the inner metal sleeve. The thickness of these sleeves is, for example, dimensioned in such a way that, when they are pushed onto the transfer cylinder, which is usually referred to as a rubber-covered cylinder, in printing machines operating in accordance with indirect printing processes, they can be expanded slightly by means of air. As shown in U.S. Pat. No. 5,429,048, such a sleeve can be pushed through the side wall of a printing machine onto the transfer cylinder previously exposed on one side. In the process, the sleeve to be pushed on is expanded with compressed air with the aid of openings provided in the transfer cylinder, so that fitting in a straightforward way is possible, after which, after the compressed air has been removed, the sleeve pushed on assumes a firm seat on the transfer cylinder.

At least one further layer which is compressible, i.e. having air inclusions, is applied—directly or indirectly—to this inner, preferably metallic carrier sleeve. At least one covering layer which, for example, can consist of an elastomeric material, is provided above this compressible layer. Using this material, the image to be printed is accepted from a printing plate, for example an offset printing plate or a sleeve-like offset printing plate, and is transferred to a printing medium.

A further non-expandable layer is preferably provided between the compressible layer (e.g. an elastomer with air inclusions) and the covering layer, for example in the form of a hard elastomeric material or, for example, in the form of short fibres (e.g. threads) which can also be embedded in the hard elastomeric material. Alternatively, a non-expandable layer or non-expandable particles, such as threads or pieces of threads, can also be introduced directly into the aforementioned volume-compressible layer.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
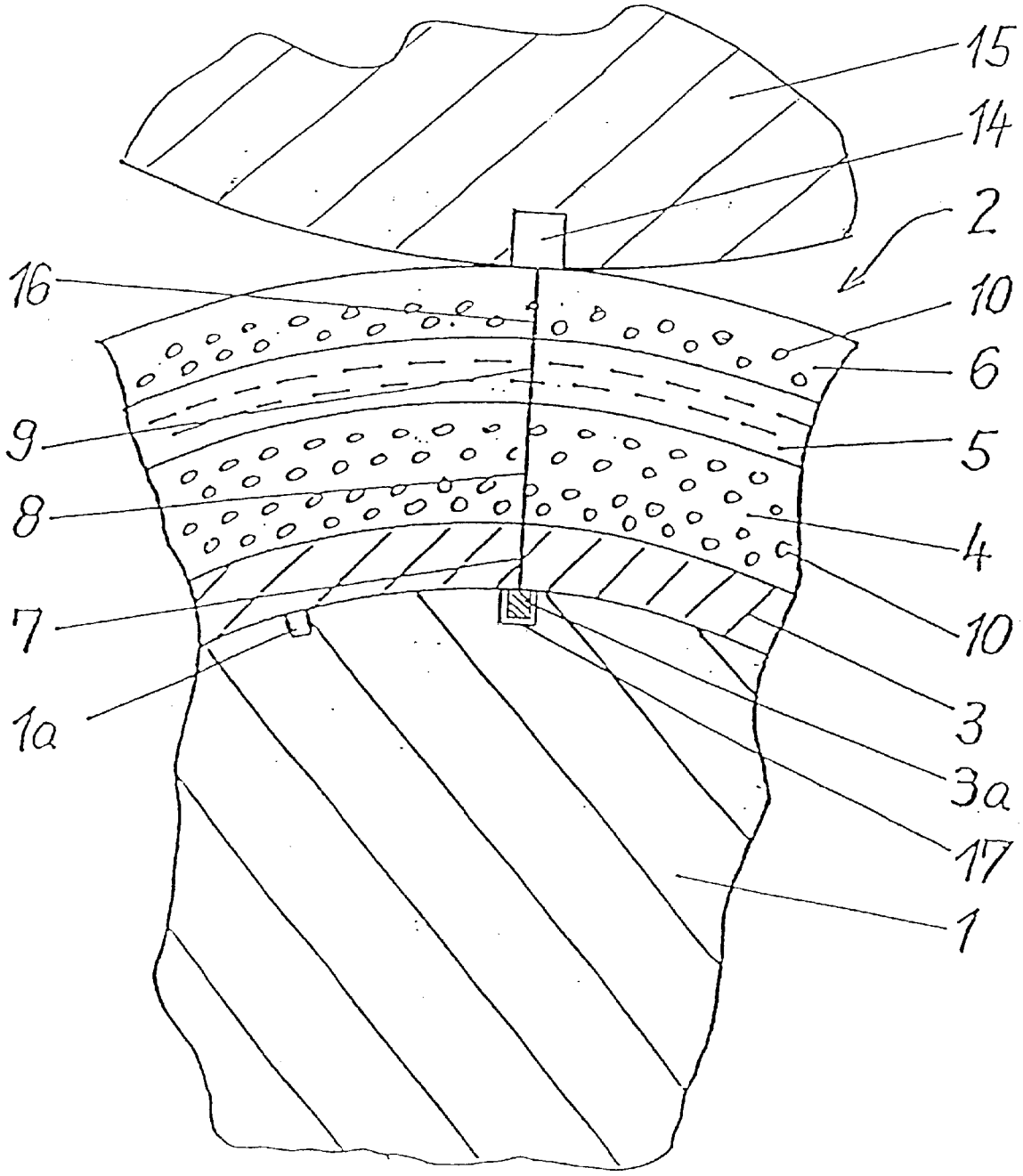
FIG. 1 shows part of a transfer cylinder with a rubber blanket sleeve and a plate cylinder in cross section.

In FIG. 1, the transfer cylinder 1 (rubber blanket cylinder) has openings or nozzles 1*a* provided at its surface. The transfer cylinder sleeve 2 (rubber blanket sleeve) applied in the above-described manner has, as was explained previously, a metal sleeve 3 which can preferably be expanded by means of air and on which a compressible layer 4 is vulcanized or adhesively bonded. Provided on the compressible layer 4 is a layer of a non-expandable material 5, preferably a hard elastomer layer with short fibres, which are not specifically designated. Provided on the non-expandable layer 5 is a covering layer 6, for example one made of a resilient material, with which printing can be carried out by the offset printing process.

According to the invention, the carrier sleeve 3 used is preferably a metal sleeve, for example one of steel, which can be expanded by means of air and which has a joint location 7. This joint location 7 can be a welded seam which is preferably formed by welding together the ends of a plate.

The carrier sleeve 3 can also be designed in a joint-free and gap-free manner, dispensing with the joint location 7 shown in FIG. 1. In the case of a metallic design of this type, production by an electroplating route is recommended. In addition, non-metallic carrier sleeves 3 can advantageously be produced without joints or gaps.

The term joint location is understood in particular to mean that a sleeve-like or cylindrical rubber or polymer layer or a sleeve-like or cylindrical metallic or non-metallic carrier is not continuous in the circumferential direction, that is to say that there is a seam or a joint in the longitudinal or axial direction. The joint location can have layers which butt up against one another. They can also appear as a gap between the ends of a layer, which is advantageously closed with an adhesive or vulcanizable material.

In addition, the compressible layer 4 likewise has a joint location 8, which can be produced by the compressible layer 4 being adhesively bonded onto the metal sleeve 3 in the form of a rubber blanket, so that the joint location 8 is formed by the ends of the rubber layer 4.

Likewise, in the event that a non-expandable layer 5 on the compressible layer 4 is used, this layer can likewise have a joint location 9 which can be formed in the above-described manner.

In addition, according to an exemplary embodiment, a covering layer 6 without a joint location is applied to a layer construction of this type, that is to say a carrier sleeve 3 preferably made of metal with a joint location 7 and at least one applied, compressible layer 4 with a joint location 8.

It is also possible for the covering layer 6—just like the compressible layer 4—to have air inclusions 10, so that the covering layer 6 also has a certain compressibility. This is advantageous as compared to the prior art and can lead to better printing results or printing behaviour and better web guidance.

The sleeve according to the invention can also be particularly advantageously produced by a welded metal sleeve 3 made of steel or aluminum or, for example, a CFR sleeve with a joint location being used, to which a conventional offset rubber blanket, for example having a compressible layer, is applied, for example adhesively bonded or vulcanized on. After that, the covering layer of the conventional rubber blanket is removed, for example ground off, and in its place a continuous covering layer 6, that is to say one without a joint, is applied, for example vulcanized on. By comparison with the known sleeves, production of this type and a sleeve construction of this type are substantially more cost-effective and have a number of advantages. In this case the joint locations 8, 9 are located one above another, since they constitute the ends of the conventional rubber blanket which has been adhesively bonded onto the carrier sleeve 3.

The joint locations 8, 9 can be arranged advantageously—but not necessarily—directly above the joint location 7.

In the case where finite individual layers are applied, that is to say an at least compressible layer 4 and a covering layer 6 and, if appropriate, a further non-expandable layer 5, the individual joint locations 7, 8, 9 may also be located at other points, as viewed circumferentially, i.e. they do not have to be located one above another as illustrated.

In the layer 5, the advantageous arrangement of short, non-expandable pieces, such as threads, is shown by way of example.

The sleeve 2 according to the invention provides a number of possible uses, which are not restricted just to the application to web-fed rotary offset printing machines. For example, this sleeve 2 can also be used in other indirect printing processes such as indirect gravure, for example, or as a roll.

It is advantageous to apply the sleeve 2 in register. This can be carried out, for example, by the sleeve 2 being pushed on in a predefined circumferential position.

For example, there can be a marking on one sleeve end and one transfer-cylinder end which, if brought into coincidence, permit registration. That is, the sleeve 2 can be pushed onto the transfer cylinder 1 in such a way that the joint locations 7, 8, 9 and, respectively, gaps in the clamping channel 14 of a plate cylinder 15 are opposite the latter in the rolling area, as shown in the drawing.

In the case of the registration described, even the covering layer 6 can have a joint or gap 16. If the gap 16 or the joints or gaps are relatively large, these can be closed with a suitable material, for example an adhesive or vulcanizable material.

By means of an appropriate, firm seat of the sleeve 2, for example the metal layer 3, on the transfer cylinder 1, it is possible to ensure that the sleeve 2 remains fixed in the register position during operation.

Alternatively, it is also possible to ensure registration by means of a form fit, for example by means of a strip 3*a* which is fixed to the inner wall of the metal sleeve 3 and which, during the mounting of the sleeve 2, can be inserted into a slot 17 running axially in the transfer cylinder 1.

In FIG. 1, all the layers 3 to 6 are provided with a joint location 7, 8, 9, 16 or a gap. It is also possible for a joint location or a gap 16 to be present only in some or only in a single layer, for example in the covering layer 6. The joint locations 7 to 9 are then omitted. In the case of the presence of a joint location 16 or a gap in the outer covering layer 6, the rubber cylinder sleeve 2 has to be fitted to the transfer cylinder 1 absolutely in register, that is to say in such a way that, in the rolling area with the plate cylinder 15, the joint location or the gap 16 is located opposite the clamping channel 14 in the said plate cylinder 15.

A special embodiment of the invention consists in making only the outer layer 6, i.e. the layer which picks up the printing image, resilient, i.e. preferably in constructing only the lower region or part with air inclusions, for example, or possibly with downwardly open air channels. A layer constructed in this way, in which non-expandable materials, for example threads or thread pieces, can also be arranged, can be arranged directly on a carrier sleeve.

It is also possible to produce the layer 3 from fibre-reinforced hard rubber—with or without a seam or gap—which, for example, can be expanded by means of compressed air and, over this, a compressible layer, then a semi-compressible layer, which may be fibre-reinforced, and then a printing covering layer can be arranged, which is very advantageous.

Figure 2:
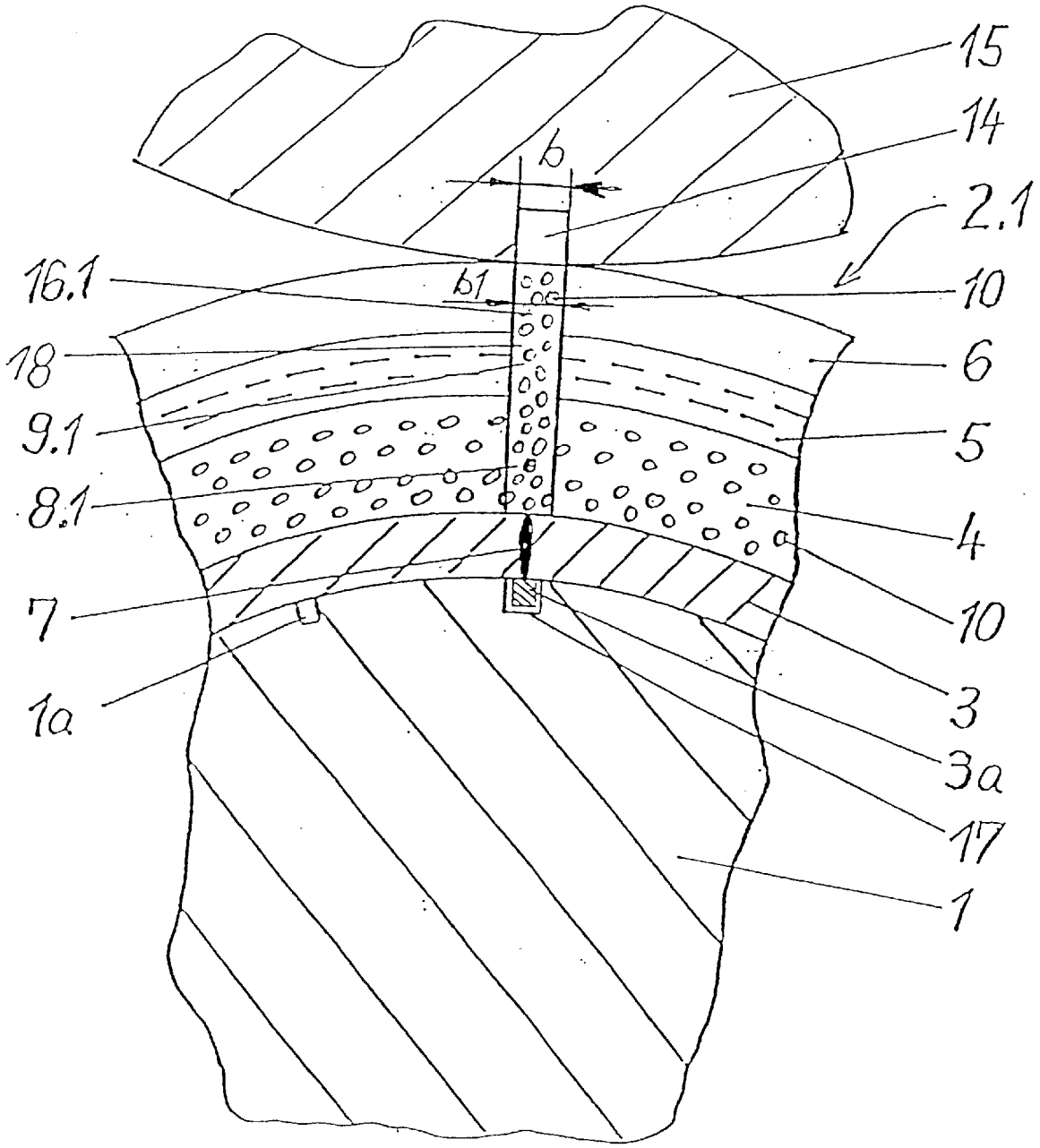
FIG. 2 shows a further variant of FIG. 1.

The rubber cylinder sleeve 2.1 shown in FIG. 2 has a layer construction similar to that of the rubber cylinder sleeve according to FIG. 1 just described. For reasons of simplicity, therefore, to a large extent the previous reference symbols are retained for repeated or similar elements or are provided with an addition "0.1". Firstly, use is again made of a carrier sleeve 3, which has a joint location 7. The carrier sleeve 3 in this case is produced from a plate whose ends are welded together, so that the joint location 7 results. The carrier sleeve 3 advantageously consists of steel. Arranged on the carrier sleeve 3 are a compressible layer 4, a non-expandable layer 5 and an outer covering layer 6. These layers 4, 5, 6 are finite, that is to say not continuous, a gap remaining between their ends in each case. The gaps are arranged over the joint location 7 of the carrier sleeve and are all filled with a compressible material 18, so that each layer 4, 5, 6 has a joint location, 8.1, 9.1, 16.1 formed by this compressible material 18. It is also possible for the compressible layer 4 and the non-expandable layer 5 to be continuous, without a joint location, and for only the joint location 16.1 in the outer covering layer 16 to be present. It is also possible for still further finite or continuous layers to be provided. In addition, the carrier sleeve 3 can be designed to be continuous, for example as a nickel sleeve produced by electroplating.

In the exemplary embodiment, the transfer cylinder 1, onto which the rubber cylinder sleeve 2.1 can be pushed, and also the rubber cylinder sleeve 2.1 have registration aids. More particularly, a strip 3*a* is fixed to the inner wall of the carrier sleeve 3 and, during the mounting of the rubber cylinder sleeve 2.1, can be inserted into a slot 17 running axially in the transfer cylinder 1. The actions of pushing the rubber cylinder sleeve 2.1 on and off is possible after they have been expanded resiliently by means of compressed air supplied through the nozzles 1*a*. The width b1 of the joint location 16.1 is about the same size as the width b of the clamping channel 14 of the plate cylinder 15 which co-operates with the transfer cylinder 1, in practice about 1 to 3 mm. The rubber cylinder sleeve 2.1 is fitted to the transfer cylinder 1 in register in such a way that, during rolling contact with the plate cylinder 15, its joint location 16.1 in the covering layer 6 comes to lie opposite the clamping channel 14 of the plate cylinder 15. Instead of this, the joint location 16.1 can also be brought into coincidence with a print-free area B (FIG. 3) in the printing image of a printing plate clamped onto the plate cylinder 15. In the case of a printing machine having four upright pages in the circumferential direction ("double content"), the joint location is opposite the clamping channel. Registering the joint location 16.1 in the covering layer 6 in this way avoids any costs in terms of a loss in printing area.

Figure 3:
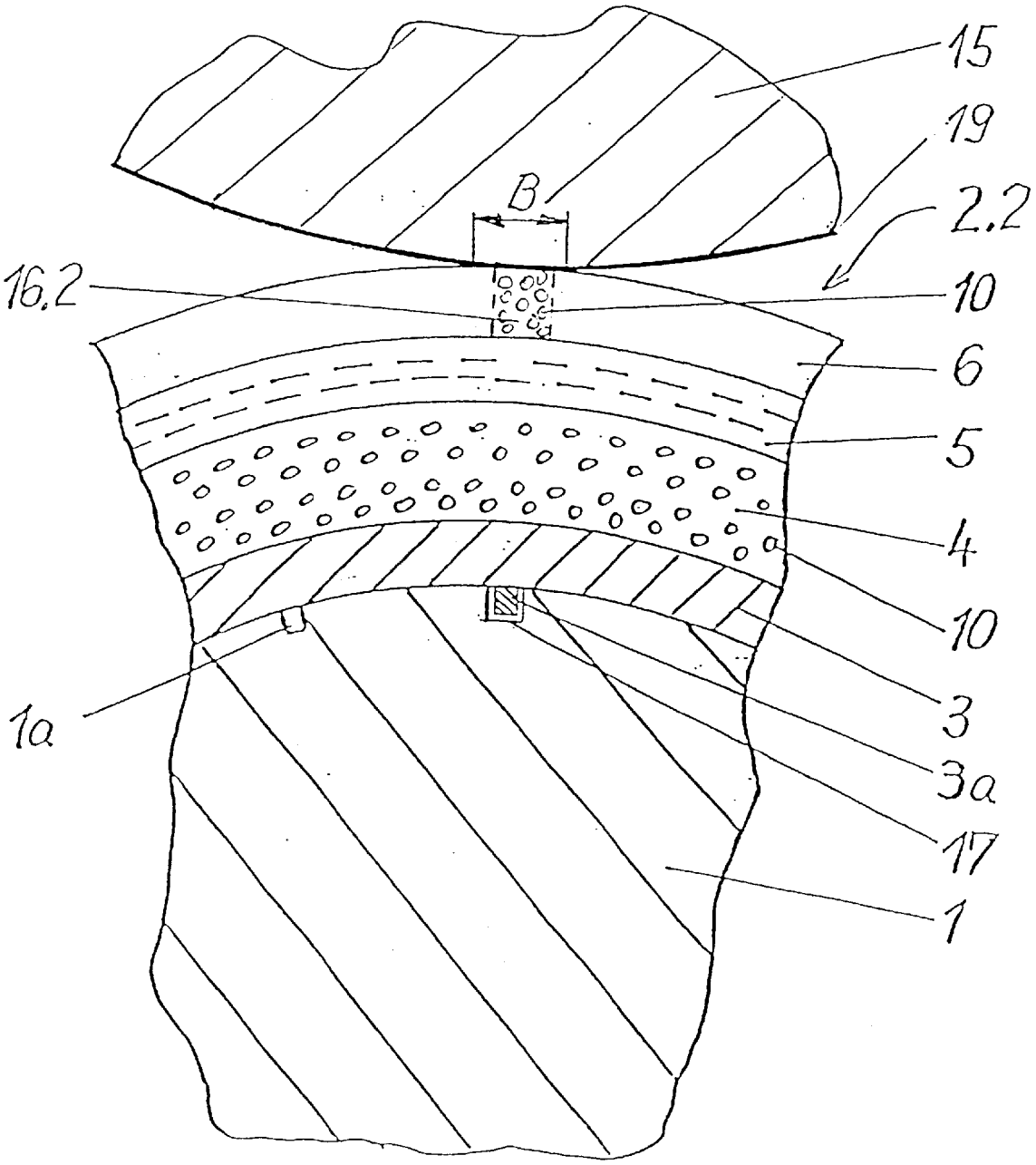
FIG. 3 shows a third variant of FIG. 1.

FIG. 3 shows a rubber cylinder sleeve 2.2 in which only the outer covering layer 6 has a joint location 16.2, while the compressible layer 4 and the non-expandable layer 5 are designed without a joint location, that is to say endlessly. Here, the covering layer 6 is advantageously fitted onto the non-expandable layer 5, for example adhesively bonded, as a plate whose ends forming the later joint location 16.2 contain air bubbles 10 and are vulcanized to each other. The carrier sleeve 3 is also designed without a joint. It again has on its inner wall a strip 3*a* which interacts with a slot 17 in the transfer cylinder 1 in such a way that, during rolling contact with the plate cylinder 15, the joint location 16.2 coincides with the print-free area B in the printing image of the printing plate 19.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A rubber cylinder sleeve for fitting to the transfer cylinder of a printing press, said sleeve comprising an inner carrier sleeve which is expandable by means of air, at least one compressible layer over said carrier sleeve, and a covering layer over said compressible layer, said covering layer being a finite layer having a joint location, said joint location being filled with a compressible material.

2. A rubber cylinder sleeve as in claim 1 wherein said compressible layer is non-expandable.

3. A rubber cylinder sleeve as in claim 1 further comprising a nonexpandable layer between the compressible layer and the covering layer.

4. A rubber cylinder sleeve as in claim 1 wherein each said layer over said carrier sleeve is a finite layer having a joint location, each said joint location being filled with a compressible material, said joint locations being radially aligned.

5. A rubber cylinder sleeve as in claim 1 wherein said compressible material contains air bubbles.

6. A rubber cylinder sleeve as in claim 1 wherein said finite layer has ends which form said joint location, said ends containing air bubbles and being vulcanized to each other.

7. A rubber cylinder sleeve as in claim 1 wherein said carrier sleeve is a finite metal sleeve having a joint location formed by a welded seam, at least one of said layers over said carrier sleeve being a finite layer having a joint location, said joint location of said carrier sleeve and said at least one joint location thereover being radially aligned.

8. A rubber cylinder sleeve as in claim 1 wherein said carrier sleeve has a registration aid which cooperates with a registration aid on said transfer cylinder.

9. A printing unit comprising a plate cylinder having a clamping channel, and a transfer cylinder arranged for rolling contact with said plate cylinder, said plate cylinder having a rubber cylinder sleeve fitted thereto, said rubber cylinder sleeve comprising an inner carrier sleeve which is expandable by means of air, at least one compressible layer over said carrier sleeve, and a covering layer over said compressible layer, said covering layer being a finite layer having a joint location, said joint location being filled with a compressible material, said transfer cylinder being registered with said plate cylinder so that said joint location lies opposite said clamping channel during rolling.

10. A printing unit as in claim 8 wherein said joint location and said clamping channel have about the same width.

11. A printing unit comprising a plate cylinder having a printing plate clamped thereon, said printing plate having a print-free area, and a transfer cylinder arranged for rolling contact with said plate cylinder, said plate cylinder having a rubber cylinder sleeve fitted thereto, said rubber cylinder sleeve comprising an inner carrier sleeve which is expandable by means of air, at least one compressible layer over said carrier sleeve, and a covering layer over said compressible layer, said covering layer being a finite layer having a joint location, said joint location being filled with a compressible material, said transfer cylinder being registered with said plate cylinder so that said joint location lies opposite said print-free area during rolling.

* * * * *